US007610708B2

(12) United States Patent
Scholl

(10) Patent No.: US 7,610,708 B2
(45) Date of Patent: Nov. 3, 2009

(54) CHAIR RAIL PICTURE FRAME

(76) Inventor: Margaret C. Scholl, 3844 W. Greenwood Dr., Bethlehem, PA (US) 18020

( * ) Notice: Subject to any disclaimer, the term of this patent is extended or adjusted under 35 U.S.C. 154(b) by 0 days.

(21) Appl. No.: 11/622,310

(22) Filed: Jan. 11, 2007

(65) Prior Publication Data

US 2008/0168692 A1 Jul. 17, 2008

(51) Int. Cl.
*A47G 1/06* (2006.01)

(52) U.S. Cl. ..... 40/725; 40/727; 40/765; 40/729

(58) Field of Classification Search ..... 40/725, 40/727, 729, 732, 765, 766, 735; 52/312, 52/716.1

See application file for complete search history.

(56) References Cited

U.S. PATENT DOCUMENTS

| | | | | | |
|---|---|---|---|---|---|
| 63,893 | A | * | 4/1867 | Holmes | 52/312 |
| 303,356 | A | * | 8/1884 | Beck | 52/312 |
| 398,953 | A | * | 3/1889 | East | 40/727 |
| 868,382 | A | * | 10/1907 | Williamson | 52/716.1 |
| 2,516,243 | A | * | 7/1950 | Murphy | 40/320 |
| 2,550,762 | A | * | 5/1951 | Bockus | 40/727 |
| 3,753,285 | A | * | 8/1973 | Gewertz | 29/425 |
| 3,775,926 | A | | 12/1973 | Brown et al. | |
| 3,842,525 | A | * | 10/1974 | Deau | 40/725 |
| 4,146,984 | A | * | 4/1979 | Lindquist | 40/765 |
| 4,201,359 | A | * | 5/1980 | Baslow | 248/345.1 |
| 4,601,573 | A | | 7/1986 | Utsugi | |
| 5,138,780 | A | * | 8/1992 | Kunkel | 40/765 |
| 5,444,956 | A | | 8/1995 | Searer et al. | |
| 6,021,619 | A | * | 2/2000 | M.ang.nsson | 52/716.1 |
| 6,212,810 | B1 | | 4/2001 | Jones | |
| 6,681,412 | B2 | | 1/2004 | Doss et al. | |
| 6,681,421 | B2 | * | 1/2004 | Carroll | 5/424 |
| 7,363,739 | B2 | * | 4/2008 | Dalsey et al. | 40/729 |
| 2004/0016164 | A1 | | 1/2004 | Gilchrist et al. | |
| 2004/0016165 | A1 | * | 1/2004 | Dwyer | 40/735 |
| 2004/0060251 | A1 | * | 4/2004 | Pamplin | 52/311.1 |
| 2005/0223611 | A1 | | 10/2005 | Dennis | |
| 2007/0084100 | A1 | * | 4/2007 | DeLong | 40/776 |

* cited by examiner

*Primary Examiner*—Lesley D Morris
*Assistant Examiner*—Christopher E Veraa
(74) *Attorney, Agent, or Firm*—Fox Rothschild LLP; Gerard P. Norton; Roman Fayerberg

(57) ABSTRACT

A chair rail for displaying decorative items is disclosed. It comprises an elongated rigid body with at least one receptacle formed in the elongated body. At least one outlet is formed in the longitudinal body extending from the at least one receptacle to a top or a bottom of the longitudinal body. Both the at least one outlet and the at least one receptacle are adopted to accept decorative items. The chair rail further includes at least one opening through which the at least one decorative item in the at least one receptacle can be observed. A structure having at least one wall with a chair rail extending for substantially entire length of the wall. The chair rail comprises an elongated rigid body, at least one decorative item attached to the elongated rigid body, and at least one opening in the elongated body through which the at least one decorative item can be observed. Example decorative items include printed photographs or digital picture frames for display of photographs.

11 Claims, 5 Drawing Sheets

CHAIR RAIL PICTURE FRAME

FIELD OF THE INVENTION

This invention relates to chair rails. More particularly, this invention relates to chair rails for displaying decorative items.

BACKGROUND

The chair rails are used to provide protection to the wall from furniture or other contact. They extend horizontally along the perimeter of the wall and are usually secured to the wall at about 32 inches from the floor, approximately the same height as the back of a chair. In addition to being functional, the chair rails may also serve a decorative purpose. Typically, the decorative features of the chair rails include the color and contour of the wood. Unfortunately, these features cannot be easily changed if the homeowners' tastes change or the house is bought by a person with preferences different than that of the last owner.

Accordingly, there is a need for a chair rail with decorative features that can be easily changed by the homeowners.

SUMMARY OF THE INVENTION

The present invention fulfills the foregoing need by providing a chair rail comprising an elongated rigid body, at least one receptacle formed in the longitudinal body and at least one outlet formed in the longitudinal body extending from the at least one receptacle to a top or a bottom of the longitudinal body. The at least one receptacle and the at least one outlet are adopted to hold at least one decorative item. At least one opening through which the at least one decorative item held in the at least one receptacle can be observed may also be provided.

In another aspect, a method for displaying decorative items is also disclosed. The method comprises providing a chair rail as described above, providing an attachment means, attaching the chair rail to a wall using the attachment means, and inserting the decorative items into the chair rail.

Yet another aspect discloses a structure having at least one wall with a chair rail extending for substantially entire length of the wall. The chair rail comprises an elongated rigid body, at least one decorative item attached to the elongated rigid body, and at least one opening in the elongated body through which the at least one decorative item can be observed.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
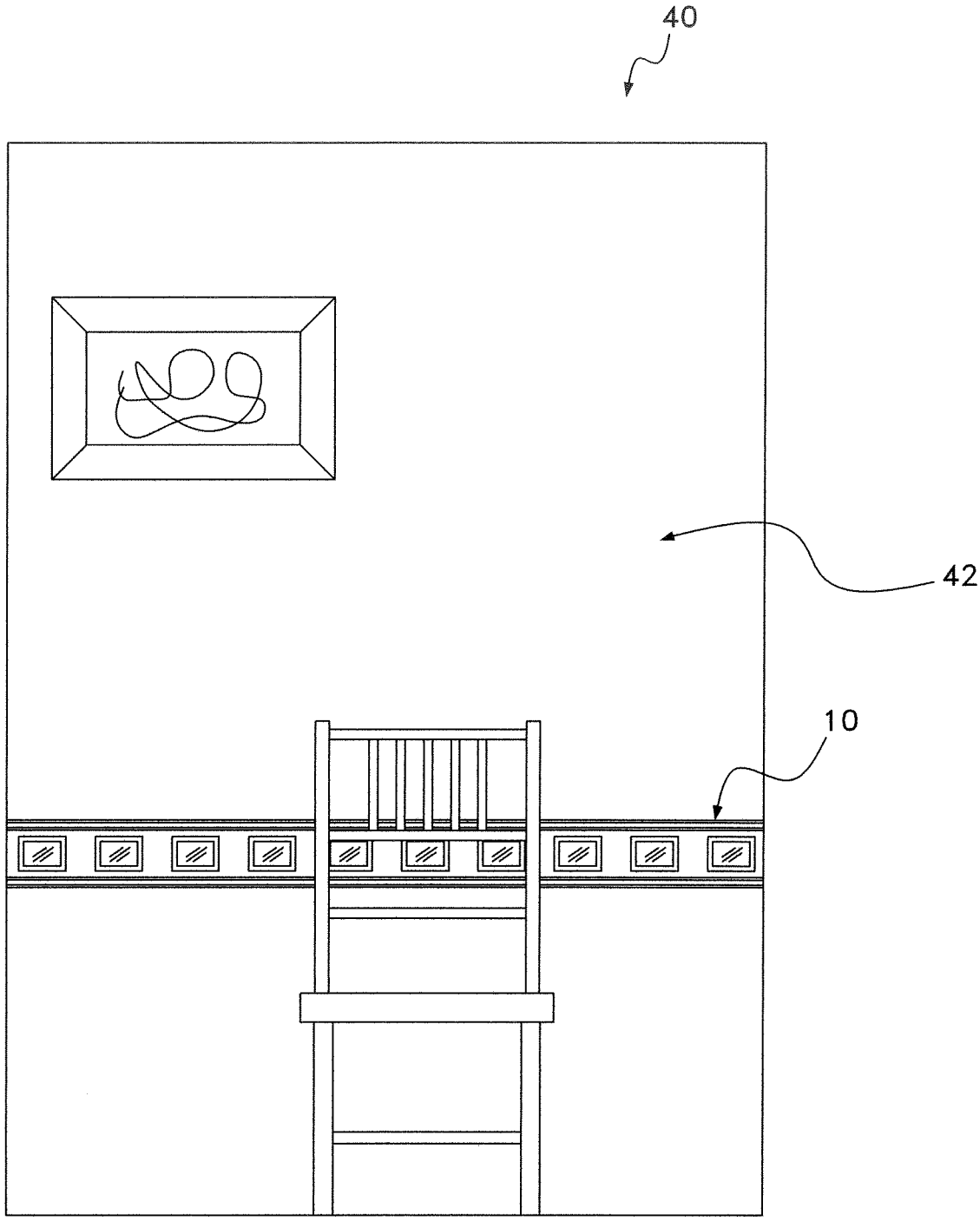
FIG. 1 shows a typical use of the chair rail.

FIG. 1 shows a room 40 inside a structure (not shown) having at least one wall 42. A structure may be any structure known to and habitable by men such as, for example, houses, office buildings, apartment buildings or stores. The structure includes at least one wall 42 which may be any wall known in the art. The chair rail 10 extends for substantially the entire length of the wall 42. Preferably, the chair rail covers at least approximately 50% of the wall, and more preferably the chair rail 10 covers at least about 75% of the wall.

The chair rail 10 may be mounted to the wall 42 by any means known in the art. Examples of such means include, but are not limited to, wood screws, wood adhesives, nails, hooks or any other conventionally used fasteners. As described above, the chair rail protects the wall from damage by chair or any other furniture. Accordingly, it is most preferable that the chair rail is attached between approximately 1 inch and 60 inches from the floor. It is most preferable that the chair rail 10 is attached approximately 32 inches from the bottom of the wall which is about the height of the back of a chair.

The chair rails may be used to display decorative items. The decorative items may be inserted behind the plurality of openings. The term "decorative item" refers to any item that enhances the appearance of the chair rail as judged by the owner. Example decorative items include, but are not limited to, photographs, postcards, stained glass, jewelry, or awards. In the preferred embodiment the decorative items comprise at least one printed photograph or at least one digital picture frame for display of photographs.

As the digital photography becomes more and more common, many people prefer to display their photographs digitally using digital picture frames rather than to print out the photographs. Accordingly, in some embodiments a digital picture frame may be inserted behind the opening 18. An example of such picture frame is presented in U.S. Pat. No. 6,717,567, incorporated herein by reference.

Figure 2:
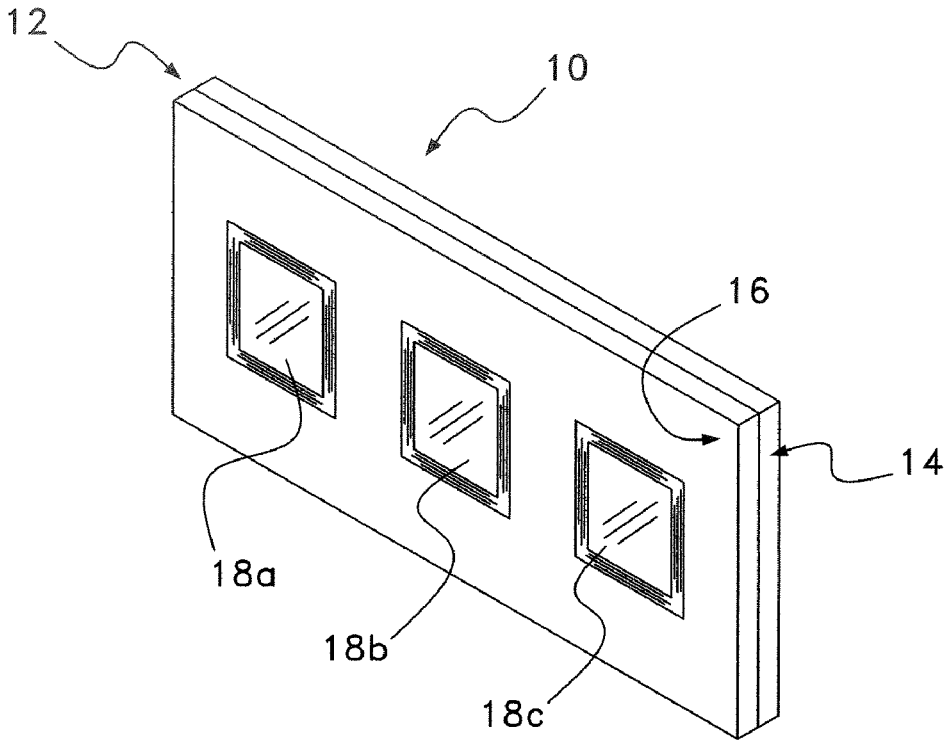
FIG. 2 is a perspective view of one of the embodiments.

The chair rail comprises an elongated rigid body. The elongated body may be made from wood, metal, plastic or any other rigid material. The elongated body may be made from a single piece of material or from two separate pieces of material. FIG. 2 shows an embodiment where the elongated body 12 comprises a back portion 14 and a front portion 16. The back and the front portions may be manufactured separately and then connected together using adhesives, screws, nails or any other method known in the art. In another embodiment shown FIG. 5, the elongated body 32 may be made from a single piece of material.

Figure 5:
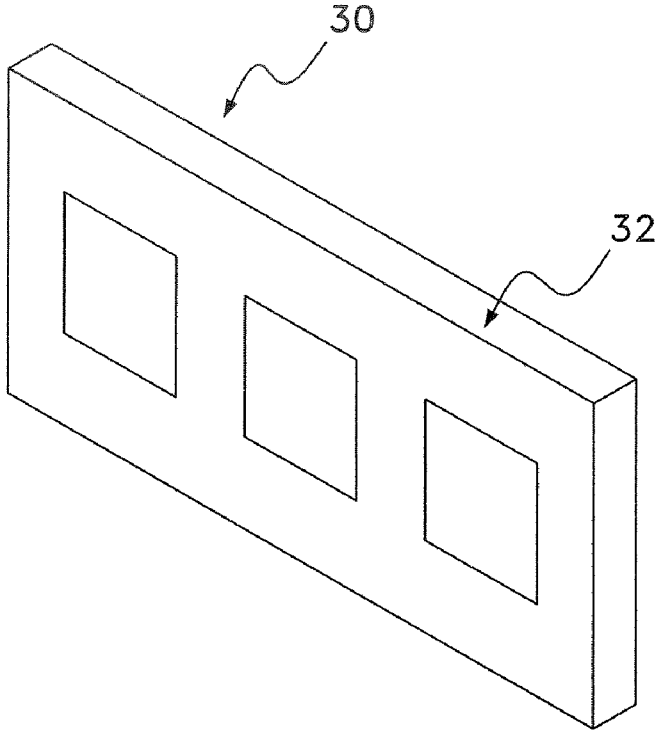
FIG. 5 is a perspective view of another embodiment.

The chair rail further comprises at least one opening through which the at least one decorative item in the at least one receptacle can be observed. For example, FIG. 2 shows at least one opening 18*a*, 18*b*, or 18*c* and FIG. 5 shows at least one opening 36*a*, 36*b*, and 36*c*. Although FIG. 2 and FIG. 5 show the openings positioned at equal intervals from each other, the distance between adjacent openings may vary. The openings may be of any shape including, but not limited to, square, rectangular, round, oval, triangular, star shaped, heart shaped. Although in the embodiments shown in the figures the openings have the same shape, the shapes of the openings may be different. Preferably, the openings are rectangular or square. If the openings are rectangular, they can be oriented either horizontally or vertically. Similarly to the shapes of the openings, the orientation of the openings may either be uniform or be different.

Preferably, the openings are sized to display entire or at least most of the decorative item. For example, if the chair rail is intended to display photographs that are 4 inches by 6 inches, the dimensions of the openings may be at least 4 inches by 6 inches. Again, the openings may have the same or different dimensions.

Figure 3:
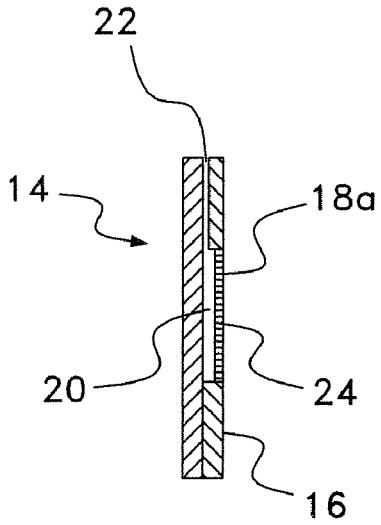
FIG. 3 and FIG. 4 are cross-sectional views of different variations of the embodiment presented in FIG. 1.
Figure 4:
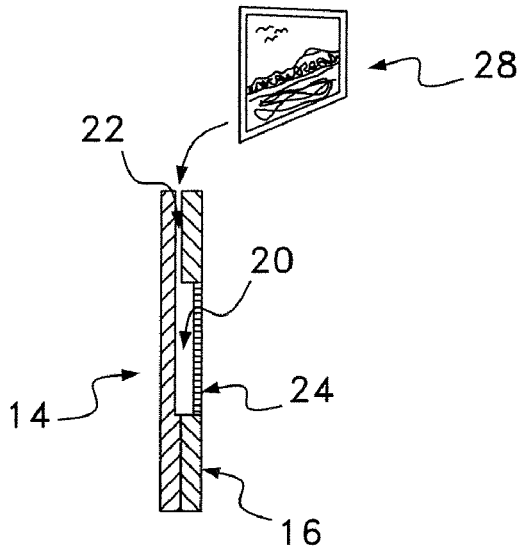
Figure 6:
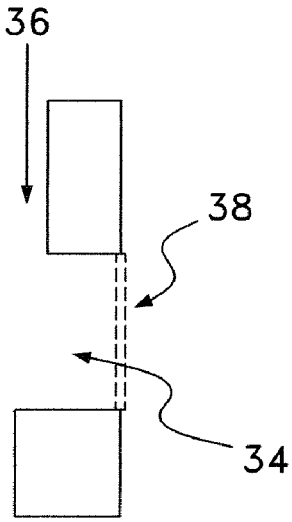
FIG. 6 and FIG. 7 are cross-sectional view of different variations of the embodiment presented in FIG. 5.
Figure 7:
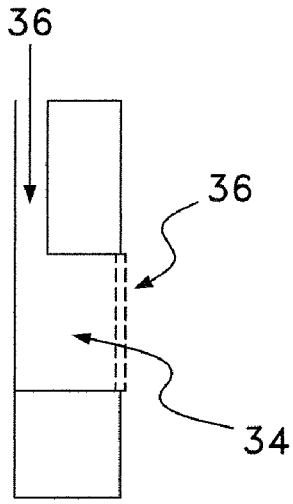

The chair rail may also comprise at least one receptacle. The at least one receptacle may act as the display area for the decorative items. In the embodiments where the elongated body is made from two portions, the at least one receptacle is formed between these portions. For example, referring to FIG. 3, the back portion 14 and the front portion 16 form the at least one receptacle 20. The receptacle 20 may be formed by removing material from either the back section 14 as shown in FIG. 4 or from the front section 16 as shown in FIG. 3 or from both sections. In the embodiments where the elongated body comprises a single piece of material, the at least one receptacle 34 may be formed on the outside of the elongated body 32 as shown in FIG. 6 or inside of the elongated body as shown in FIG. 7.

Additionally, some embodiments may include at least one outlet 22 or 36 that extends from the at least one receptacle to the top of the elongated body 12 or 32 respectively, as shown in FIGS. 3, 4, 6, and 7. Alternatively, the outlet may extend to the bottom of the elongated body 12 or 32. The at least one outlet facilitates easy exchange of decorative items by allowing the decorative items to be inserted or removed from the chair rail 10 without detaching the chair rail from the wall.

The at least one outlet 22 and the at least one receptacle 20 are adapted to accept the decorative items. Although the decorative items may be very narrow such as photographs, it is preferable that the at least one outlet 22 and the at least one receptacle 20 are sized to accept wider items as well. This provides the homeowner with a larger selection of decorative items that can be used with the chair rail. In cases where the at least one receptacle 20 is substantially wider than the decorative item, a filler material such as cardboard or foam may be used to press the decorative item against the opening and/or to keep the decorative item from moving.

The chair rail may further include at least one transparent panel aligned with the at least one opening. Such panels 24 and 38 are shown in FIGS. 3 and 6 respectively. The transparent panel 24 may comprise, for example, glass, acrylic or see-through fabric.

Figure 8:
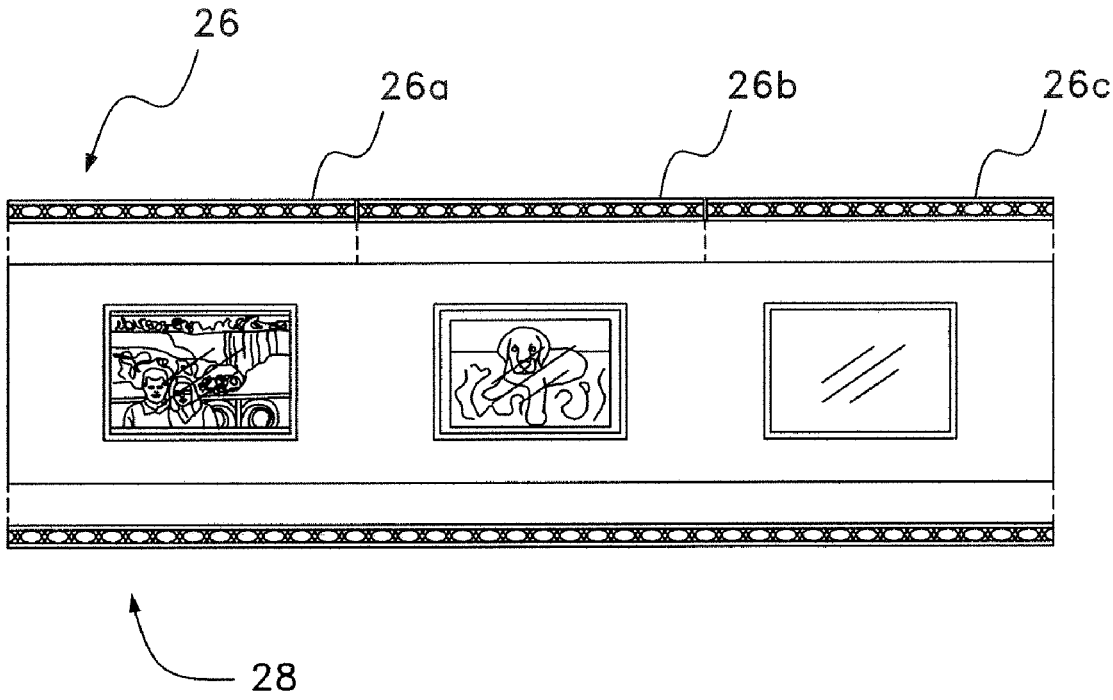
FIG. 8 is a front elevational view of yet another embodiment.
Figure 9:
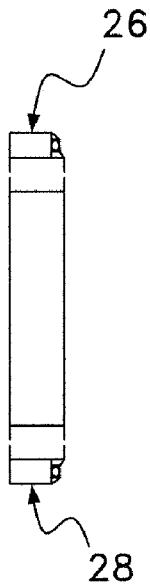
FIG. 9 is a side view of an embodiment that combines features of the embodiments shown in FIG. 5 and FIG. 8.
Figure 10:
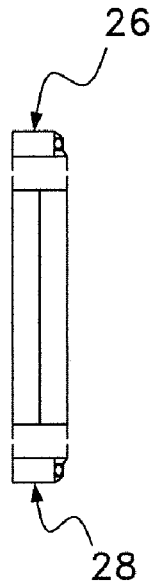
FIG. 10 is a side view of an embodiment that combines features of the embodiments shown in FIG. 2 and FIG. 8.

In some embodiments, the at least one outlet may be covered. Accordingly, the chair rail may further comprise a cover 26 removably attached to the elongated body 12, as shown in FIG. 8. Alternatively, the cover may be attached to the bottom of the elongated body. The cover may be made from any material, but preferably it is made from the same material as the elongated body. The cover may also include decorative features.

The cover may be of the same length as the elongated body or may be made up of a several shorter pieces 26*a*, 26*b*, and 26*c* that add up to the same length as the elongated body. The shorter pieces are more convenient and easier to handle and it would only require one person to detach the cover from the elongated body. Additionally, shorter pieces may be preferred when the homeowner wants to change only a single decorative item at a time.

Figure 11:
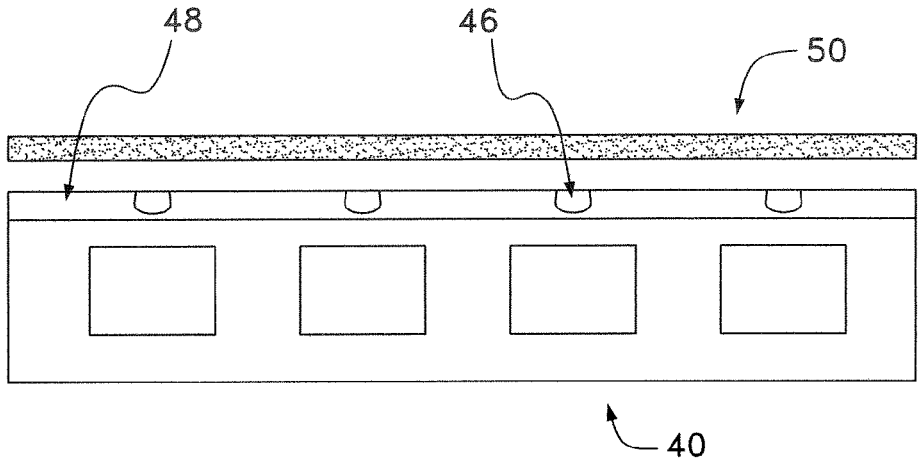
FIG. 11 is a front view of preferred embodiment.
Figure 12:
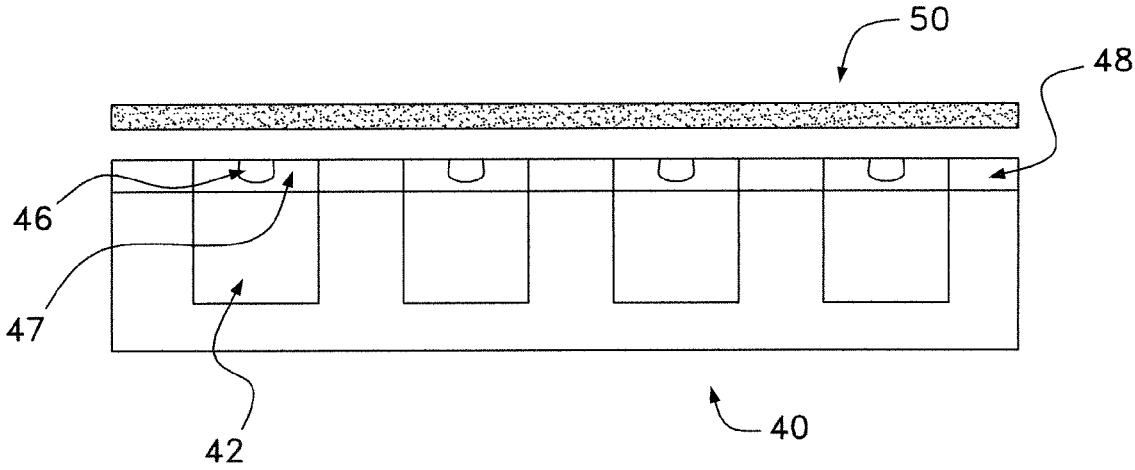
FIG. 12 is a back view of the embodiment shown in FIG. 11.
Figure 13:
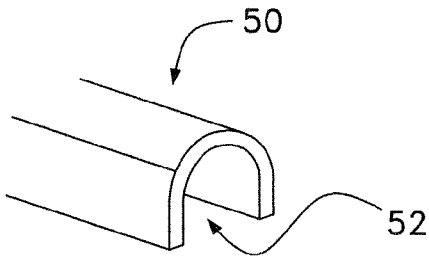
FIG. 13 is a side view of one embodiment of the cover as used in the embodiment shown in FIG. 11 and FIG. 12.

It is preferable that the cover is attached to the elongated body by a method that allows for easy removal of the cover to expose the at least one outlet. The at least one outlet may need to be exposed in order to place or change decorative items. In the preferred embodiment, the cover 50 may comprise a channel 52 as shown in FIG. 13 that may fit a flange 48 located on the top of the longitudinal body 40 as shown in FIG. 11 and FIG. 12. To attach the cover to the longitudinal body, the flange 48 can be inserted into the channel 52 in the cover 50.

Removing the cover 50 exposes the at least one outlet 48 of which allows a decorative item to be placed or removed from the at least one receptacle 42, as shown in FIG. 11 and FIG. 12. Removing the cover 50 also exposes at least one cut-out 46. The at least one cut-out 46 may allow the user to easily take hold of the decorative item located in the at least one receptacle 42.

Some embodiments may also include at least one decorative molding 28 attached to the elongated body 12, as shown in FIG. 5. The molding may be attached removably similar to the cover or it may be attached permanently. The molding may be made from any material, but preferably it is made from the same material as the longitudinal body. The molding may include decorative features and a projection extending beyond the front section of the longitudinal body to prevent furniture from damaging plurality of transparent panels and/or decorative items.

In the embodiments where both the molding 28 and the cover 26 are present, the molding is attached to the longitudinal body opposite to the cover. In the embodiments without the cover, decorative moldings may be attached to both the top and the bottom of the longitudinal body. The decorative molding may have the same or different design than the cover.

A method of displaying decorative items is disclosed. The method comprises providing a chair rail as described above, and attaching the chair rail to the wall. The chair rail is sized to extend for substantially the entire length of the wall. At least one decorative item can be inserted into the at least one receptacle if desired by the homeowner.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

What is claimed is:

1. A method of displaying decorative items comprising:

providing a chair rail comprising:

an elongated rigid body;

at least one receptacle formed in the elongated body adapted to hold at least one decorative item;

at least one outlet formed in the elongated body extending from the at least one receptacle to a top or a bottom of the elongated body wherein the at least one receptacle and the at least one outlet are adapted to accept decorative items; and at least one opening through which the at least one decorative item in the at least one receptacle can be observed; and attaching the chair rail to a wall wherein the chair rail extends for substantially the entire length of the wall.

2. The method of claim 1, wherein the chair rail is attached between approximately 1 inch and 60 inches from the floor.

3. The method of claim 1, wherein the chair rail further comprises at least one transparent panel aligned with the at lest one opening.

4. The method of claim 1 further comprising a cover attached to the elongated body.

5. The method of claim 1 further comprising at least one molding attached to the elongated body.

6. The method of claim 1, wherein the at least one receptacle is adapted to accept at least one digital picture frame.

7. A structure having at least one wall with a chair rail extending for substantially entire length of the wall, the chair rail comprising:

an elongated rigid body;

at least one receptacle formed in the elongated body and adapted to hold at least one decorative item;

at least one outlet extending from the at least one receptacle to a top or a bottom of the elongated body;

at least one decorative item attached to the elongated rigid body, wherein the at least one decorative item can be changed without removing the chair rail from the at least one wall; and at least one opening in the elongated body through which the at least one decorative item can be observed.

8. The structure of claim 7, wherein the chair rail further comprises at least one transparent panel aligned with the at least one opening.

9. The structure of claim 7, wherein the at least one decorative item comprises at least one photograph or at least one digital picture frame.

10. The structure of claim 7, wherein the chair rail is affixed to the at least one wall between approximately 1 inch and 60 inches from the floor.

11. The structure of claim 7, wherein the chair rail further comprises a cover attached to the elongated body.

* * * * *